US007325331B2

(12) United States Patent
Luukkanen

(10) Patent No.: US 7,325,331 B2
(45) Date of Patent: Feb. 5, 2008

(54) METHOD AND EQUIPMENT FOR DRYING A PULP WEB USING HOT AIR OF DIFFERENT TEMPERATURES

(75) Inventor: Matti Nestori Luukkanen, Imatra (FI)

(73) Assignee: Metso Paper, Inc. (FI)

( * ) Notice: Subject to any disclaimer, the term of this patent is extended or adjusted under 35 U.S.C. 154(b) by 0 days.

(21) Appl. No.: 10/432,918

(22) PCT Filed: Nov. 28, 2001

(86) PCT No.: PCT/FI01/01037

§ 371 (c)(1),
(2), (4) Date: May 28, 2003

(87) PCT Pub. No.: WO02/50370

PCT Pub. Date: Jun. 27, 2002

(65) Prior Publication Data

US 2004/0025369 A1 Feb. 12, 2004

(30) Foreign Application Priority Data

Nov. 29, 2000 (FI) ..... 20002618

(51) Int. Cl.
*F26B 3/00* (2006.01)

(52) U.S. Cl. ..... 34/446; 34/451; 34/476; 34/461; 34/491

(58) Field of Classification Search ..... 34/446, 34/451, 476, 491, 461, 540, 636
See application file for complete search history.

(56) References Cited

U.S. PATENT DOCUMENTS 3,864,842 A * 2/1975 Sawyer ..... 34/446

(Continued)

FOREIGN PATENT DOCUMENTS

FI 28496 12/1956

(Continued)

OTHER PUBLICATIONS

Declaration of Magnus Hägglund, Department Head Fibres Production Pulp, M-real Sweden AB, Husum-Wifsta Fabriker, dated Jun. 13, 2006.

(Continued)

*Primary Examiner*—Jiping Lu
(74) *Attorney, Agent, or Firm*—Andrus, Sceales, Starke & Sawall, LLP

(57) ABSTRACT

The invention relates to a method for drying a fibre-based pulp web (2), and to a drying box (1) used in the method. According to the invention, the drying box (1) contains drying zones (9*a*-9*e*), to each one of which hot drying air can be blown independently so that the web can be dried in the various zones at different temperatures. The temperature of the first zone (9*a*) can thus be lower than that of one or more subsequent zones (9*b*-9*e*) to prevent the water in the incoming wet web from boiling. The last zone in the drying box (1) can be a separate cooling zone (11), wherein the web is cooled by indoor air from outside the box. The temperatures can be adjusted by adjusting, with the aid of valves (8), the pressure of the steam, which heats the drying air that is fed into the various zones (9*a*-9*e*), on the basis of the temperatures measured by the sensors (23) for the various zones and of the basis weight and moisture measurements carried out on the web (2) that goes into the box (1) and comes out of the box.

14 Claims, 2 Drawing Sheets

U.S. PATENT DOCUMENTS

| | | | | | |
|---|---|---|---|---|---|
| 4,021,931 | A | | 5/1977 | Russ et al. | |
| 4,074,441 | A | * | 2/1978 | Helversen et al. | 34/122 |
| 4,204,337 | A | * | 5/1980 | Roos et al. | 34/485 |
| 4,505,053 | A | | 3/1985 | Andersson et al. | |
| 4,646,447 | A | * | 3/1987 | Aznavorian | 34/504 |
| 4,719,708 | A | | 1/1988 | Karlsson et al. | |
| 5,394,622 | A | | 3/1995 | Evans et al. | |
| 5,471,766 | A | * | 12/1995 | Heikkila et al. | 34/461 |
| 5,603,168 | A | * | 2/1997 | McMahon, Jr. | 34/471 |
| 5,605,189 | A | * | 2/1997 | Schlickhoff | 165/263 |

FOREIGN PATENT DOCUMENTS

| | | |
|---|---|---|
| FI | 66576 | 12/1984 |
| FI | 82109 | 1/1991 |
| FI | 87587 | 10/1992 |
| FI | 92421 | 9/1993 |
| FI | 973759 | 9/1997 |
| FI | 102981 | 3/1999 |
| GB | 1452383 | 10/1976 |
| WO | 97/37181 | 10/1997 |
| WO | 99/36615 | 7/1999 |
| WO | WO 99/57367 | 11/1999 |

OTHER PUBLICATIONS

English translation of Declaration of Magnus Hägglund, Department Head Fibres Production Pulp, M-real Sweden AB, Husum-Wifsta Fabriker, the translation being dated Sep.9, 2006.

Communication of a Notice of Opposition dated Oct. 4, 2006, Notice of Opposition to a European Patent No. 1 379 727 B1, and supporting papers.

Selected portions from "Torkning av Massa del 2", Stig Salkvist, Skogsindustrins Utbildning i Markaryd AB.

"Yankee Hoods and Flotation Dryers" by J. A. Villalobos, published in 1988 Practical Aspects of Pressing and Drying Seminar.

Selected portions from "Puumassan Valmistus" ("Manufacture of Wood Pulp"), Nils-Erik Virkola, Suomen Paperi-insinöörien yhdistys r.y., ISBN 951-99117-3-1- (1983), incl. translation of front pages, part of contents list, and passage of page 969-970.

* cited by examiner

METHOD AND EQUIPMENT FOR DRYING A PULP WEB USING HOT AIR OF DIFFERENT TEMPERATURES

CROSS REFERENCE TO RELATED APPLICATION

The present application is the U.S. national stage application of International Application PCT/FI01/01037, filed Nov. 28, 2001, which international application was published on Jun. 27, 2002 as International Publication WO 02/50370. The International Application claims priority of Finnish Patent Application 20002628, filed Nov. 29, 2000.

SUMMARY OF THE INVENTION

The invention relates to a method for drying a fibre-based pulp web, wherein the web travels in a drying box, into which hot drying air is blown. Furthermore, the invention relates to a drying box intended for applying the method.

In present fan dryers of pulp web, the drying air is heated by generally conducting it through a bank of boilers heated with steam, and after that, it is taken to a drying box, where it is blown against the surface of the moving web from nozzle blocks located on the routine of the web. Typically, the drying box contains a large number of nozzles, into which the stream of drying air heated by the batteries is distributed. Drying is adjusted by changing the temperature of the drying box on the basis of the moisture measured for the dried web coming out of the box.

In present drying boxes, the length of the pulp web inside the box at each moment is about 1000 to 1200 m and, depending on the web's travelling speed, the retention time in the box is about 5 to 10 min. One of the problems of the drying process is that drying is too intensive both at the initial stage and the final stage of the process. In both cases, defective drying causes defects in the pulp web. At the initial stage of drying, the water contained by the moist web coming to the temperature of the drying box starts boiling, which, if worse comes to worse, splits the web, causing an interruption in use and loss of production. At the final stage of drying, when the web is already dry and evaporation is minor, drying in turn has an adverse effect by excessively increasing the surface temperature of the web. Such excessive drying not only impairs the quality of the dried web but also means unnecessary loss of energy.

Problems that are due to defective control of the drying process are emphasized in the newest drying machines, the production velocities of which have increased. For example, cutting the web successfully in sheets in these machines requires a straighter and more faultless web than before, exhibiting considerable moisture variations no more in the direction of travel, i.e., the longitudinal direction of the track than in the transversal direction thereof.

DETAILED DESCRIPTION OF THE INVENTION

The purpose of the invention is to provide a solution that eliminates the problems described above, enabling controlled drying of the pulp web even at the high velocities of current drying machines. The invention is characterized in that the drying box used for drying the web comprises drying zones, into which the air is blown independently so that the web is dried in the various zones at different temperatures.

In present drying processes, wherein drying in the drying box is effected at the same temperature from beginning to end, the drying process is not optimal, because the drying temperature in the drying box is determined by the evaporation in the initial part of the box, which is effected so as not to harm the web. The middle part of the box, which would allow a higher temperature and more effective evaporation, cannot be utilized; therefore, the efficiency is poor. The middle part is the longest part of the box. At the final stage of the drying, the temperature is correspondingly too high, the amount of water to be evaporated is small and the web is warm, whereby the extra energy is of no use. In the present drying process, any moisture variations in the web coming to the box travel through the box, because the measurement that is fed back does not notice it until it goes out of the box. In this way, 1000 to 1200 m of web that is dried in an uncontrolled way goes to the cutter.

However, the above problem is solved in accordance with the invention by dividing the drying box into zones, which can be adjusted separately and which enable an optimal drying effect both at the initial, middle, and final stages of the process. This results in a higher-quality dried pulp web than before, in addition to which, the invention also avoids wastage of drying energy.

The web drying process according to the invention particularly makes it possible to obtain a straight and homogeneous dried web that has uniform moistness, so that the web can be cut into sheets at the high velocities of the present drying machines. Regarding this, an accurate control of the drying process is a critical factor. A further advantage of the accurately adjusted drying according to the invention is a decrease in the linting of the web.

The different drying temperatures of the various drying zones of the drying box can be provided by simply leading drying air at various temperatures to the zones. The drying process can also be influenced by adjusting the amount of air blown to the various zones.

It is especially preferable to adjust the temperature of the first drying zone in the web's direction of travel to a lower level than the temperature of one or more subsequent zones. This prevents uncontrolled boiling of the moisture in the web coming into the drying box and any failures to the web caused by the boiling, or running problems of the drier.

Similarly, it is preferable to lead air to the zone that in the drying box is last in the web's direction of motion, the temperature of the air being lower than that of one or more preceding drying zones. This essentially prevents an uncontrolled increase in the temperature of the already dried web, and any resulting quality problems. Energy is also saved, when the excessive drying of the web at the final stage of the process is avoided. The last zone of the drying box preferably constitutes a cooling zone, wherein the temperature of the zone is lowered from that in the preceding drying stages.

According to the invention, the drying air lead to the various drying zones can be heated in different ways. Steam can be used for heating in a way known per se, giving a temperature of about 180° C. maximum. The drying air heated with steam is suitable to be lead to the first drying stage(s) of the process, where the optimal temperature is lower, for example, in the order of 120-170° C. The drying air used for the following drying stages can be heated with a fuel, such as natural gas, whereby higher air temperatures can be reached, as much as 250-300° C., if so desired. A preferable temperature range in the middle stages of the process is about 150-200° C.

In the box, it is possible to maintain temperature differences between the various drying zones without having to isolate the zones from each other. If different amounts of air are used in the various zones, being adjusted by the number of revolutions of a fan or by a control valve, closing planes should be arranged between the zones to prevent vertical streams in the drying box.

The air that is lead to the last zone of the drying box, which is a cooling zone, is taken from the machine room, for example, whereby the air is not heated. The cooling zone is separated from the rest of the drying box by a thermally insulated plane.

According to the invention, the air blowing to the various drying zones can be adjusted during the process on the basis of temperatures measured for the various drying zones, the moisture and the basis weight of the web going inside the drying box, or the moisture measured for the web coming out of the drying box. As selected, the adjustment of the various zones can be based on these measurement values or combinations thereof in various ways.

The invention also relates to equipment intended for applying the method described above, consisting of a drying box, through which the fibre-based pulp web that is to be dried can be lead, and which is provided with nozzles for blowing hot drying air. According to the invention, the drying box is characterized in comprising adjustable blow nozzles, which in the web's direction of travel form drying zones, in which the web can be dried at different temperatures. As mentioned above, the box can constitute a continuous drying space without partition walls between the drying zones.

BRIEF DESCRIPTION OF THE DRAWINGS

In the following, the invention is described in detail with the aid of an example and with reference to the appended drawings, in which.

DETAILED DESCRIPTION OF THE DRAWINGS

Figure 1:
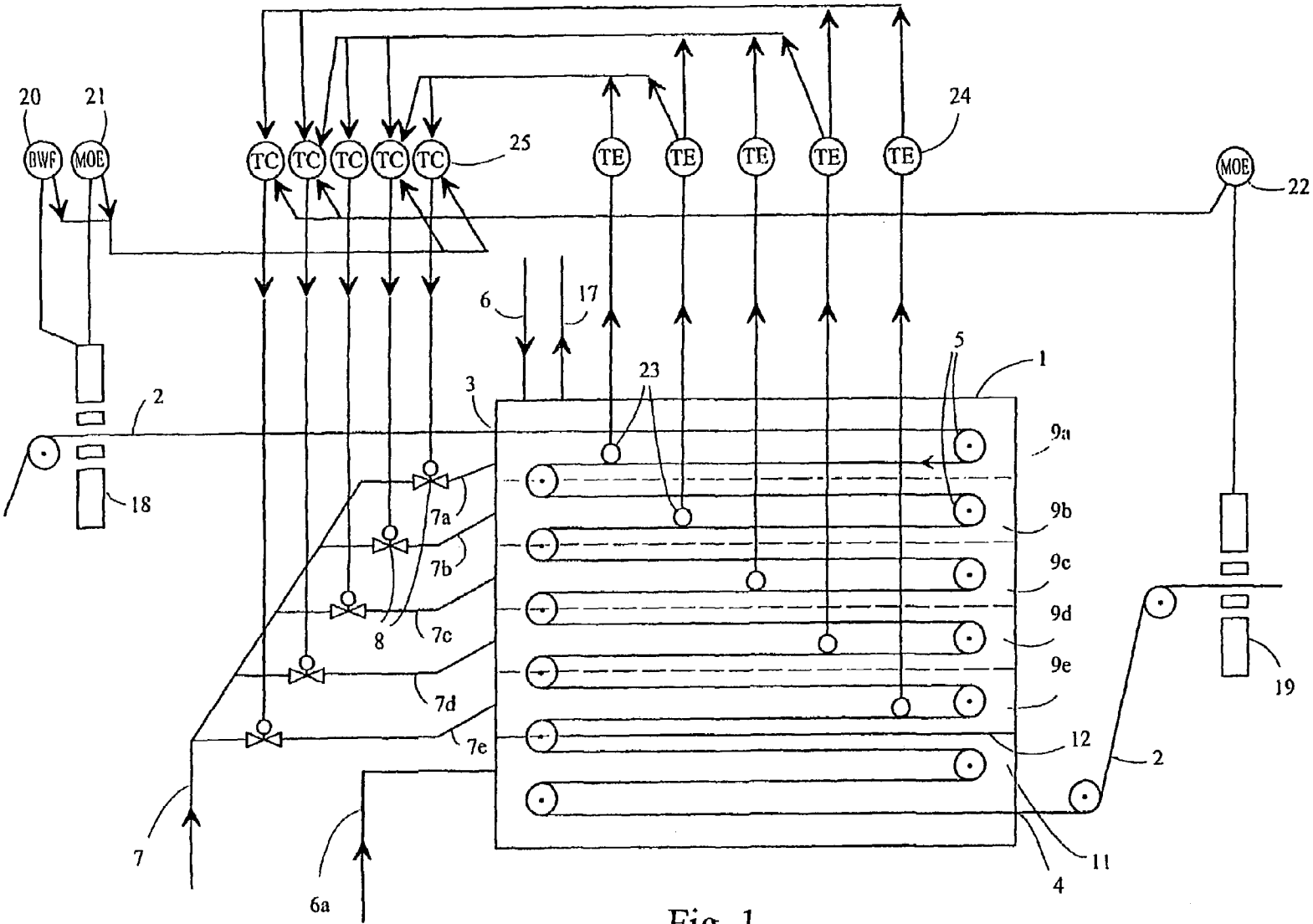
FIG. 1 shows certain drying equipment of pulp web according to the invention.
Figure 2:
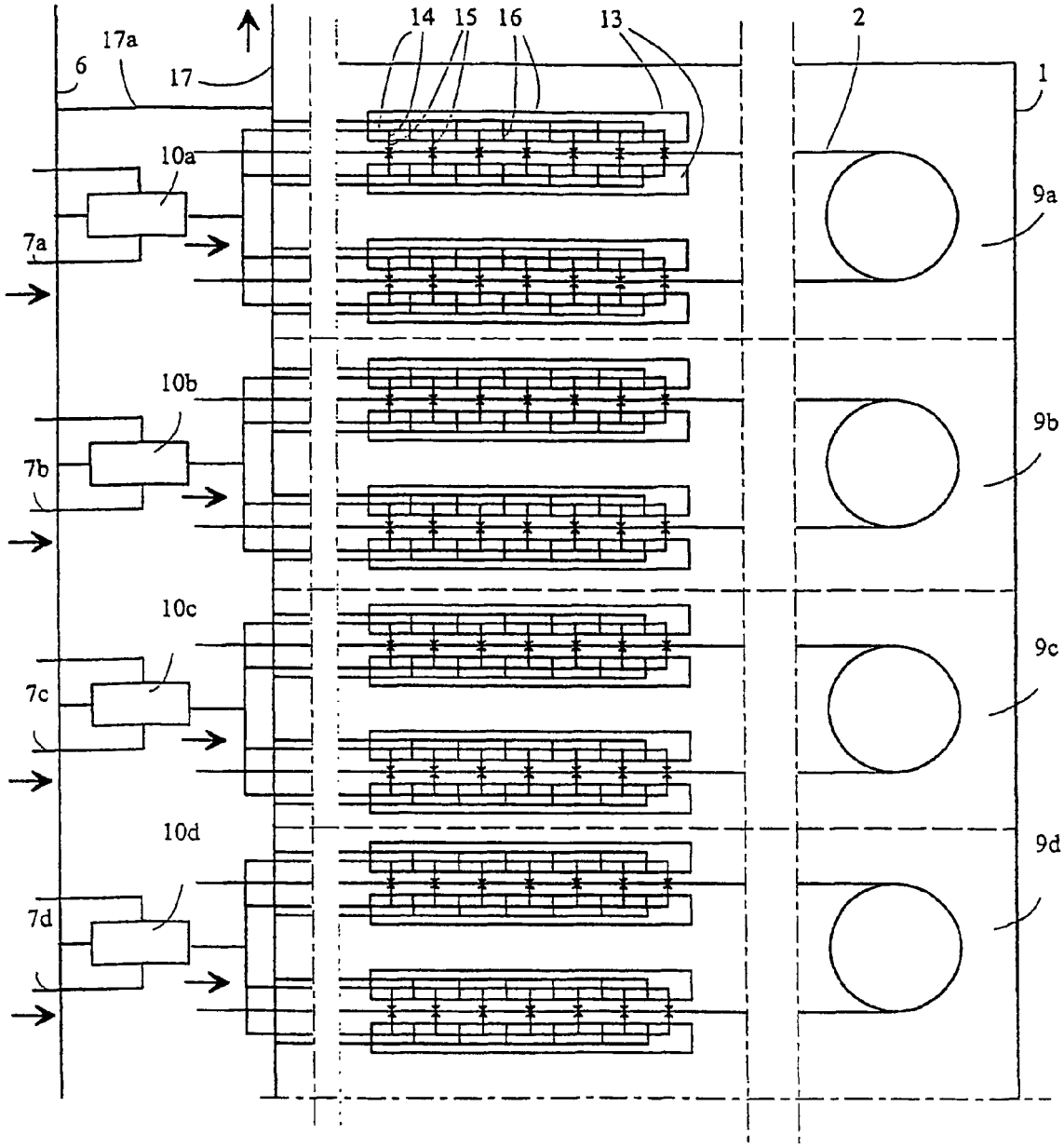
FIG. 2 shows parts of the equipment according to FIG. 1 in more detail and in a larger scale.

The drying equipment shown in FIGS. 1 and 2 is intended for drying cellulose pulp, which is obtained from pulping or bleaching, from a dryness of about 50% after the compression stage to a final dryness of about 90%, wherein there is balance between the mass and the ambient air. The equipment comprises a drying box 1, through which the pulp web 2 to be dried is lead. The drying box 1 is a space defined by walls, which is closed, except for the inlet and outlet ports 3, 4 of the pulp web 2. The drying box 1 contains control rolls 5, which guide the pulp web 2 through the box along a reciprocating winding route. FIG. 1 should be taken schematically regarding the routing of the web 2; in practice, the length of the web 2 inside the. drying box 1 can be about 1000 to 1200 m and the number of superimposed runs in the box can be several dozens.

The wet pulp web 2 is dried in the drying box 1 by using drying air that is brought there from a channel 6 according to FIG. 2, the air being heated with steam in batteries that work as heat exchangers. According to FIG. 1, steam is lead to the drying box 1 from a channel 7, which branches into five parts so that five parallel steam channels 7*a*-7*e* lead to the drying box, each channel being provided with a control valve 8. The valves 8, which adjust the steam pressure and, consequently, its temperature, are used to adjust the temperature of the drying air that goes to the various drying zones 9 of the drying box 1. According to FIG. 1, the drying box 1 comprises five superimposed drying zones 9*a*-9*e*, each one of them having a battery 10 of its own (batteries 10*a*-10*d* in FIG. 2), where the drying air coming to the zone is heated with steam conducted from the respective steam channel 7 (channels 7*a*-7*d* in FIG. 2). Each drying zone 9*a*-9*e* is thus provided with a separate, independently adjustable feed of drying air. In FIG. 1, the limits of the drying zones 9 are indicated with dashed lines. In practice, however, the zones 9 are not separated from each other by partitions or the like, but the drying zones of the drying box 1 are formed from one integral space. The drying zones 9*a*-9*e* are formed, when drying air of different temperatures is fed into the drying box 1 from the various zones, so that the web 2 in the various zones is dried at different temperatures.

A zone 11, which is lowest in the drying box 1 and provided with an air feed channel 6*a* of its own, constitutes a cooling zone. The cooling zone 11 is separated from the preceding drying zones 9 of the drying box 1 by a partition wall 12. Air is fed into the cooling zone 11, the temperature of the air being lower than that in the immediately preceding drying zones 9*e*, 9*d*, which is used to cool the web 2 before it exits the drying box 1, at the same time, preventing it from over drying and heating at the final stage of drying. The cooling air can be, for example, indoor air that is taken from the machine room outside the drying box 1.

The blow nozzles of drying air in the drying box 1, which are not shown in FIG. 1, are shown in FIG. 2. The nozzles are in nozzle blocks 13 that are located on both sides of the pulp web 2, the blocks below the web being located at a distance of about 3-5 mm from the web. The purpose of the hot air blown from these nozzle blocks is not only to dry the web 2 but also to carry it. The air blown from the nozzle blocks above the web 2 only participates in drying the web. In FIG. 2, the drying air channels and the blow nozzles located in the nozzle blocks 13 and coming from batteries 10 are marked with reference numbers 14 and 15. Furthermore, sets of channels 16 are arranged in the nozzle blocks 13, sucking air from the drying box 1 into a discharge channel 17. By using continuous blowing of drying air and simultaneous discharge suction, the temperature differences according to the invention are maintained in the drying box 1 between the various drying zones 9*a*-9*e* of the box. A circulating channel 17*a* for circulating the drying air is arranged from the discharge channel 17, joining the inlet channel 6 of the drying air.

In FIGS. 1 and 2, which are schematic in nature, each drying zone 9 comprises two horizontal, superimposed web runs. In practice, there are more, even dozens of them in one zone that operates depending on a common air feed channel. The length of the nozzle blocks 13 and the number of nozzles 15 in them can also vary, and several separate blocks can be arranged along one web run sequentially in the web's direction of travel, as needed.

For adjusting the drying process, measuring bars 18, 19 are placed on the routing of the pulp web 2 before and after the drying box 1. The measuring bar 18 before the drying box 1 follows the basis weight of the web 2 by using a sensor 20 and its moisture by a sensor 21. The measuring bar 19 after the drying box 1 follows the moisture of the dried web by a sensor 22. Each drying zone 9*a*-9*e* of the drying box 1 is further provided with a temperature sensor 23 and a thermocouple 24 of its own for following the drying temperature in the zones. The said basis weight and moisture sensors 20, 21, 22 and the thermocouples 24 are connected to air pressure and temperature controllers 25, which affect the various drying zones 9*a*-9*e*, in the way indicated in FIG. 1. The system makes it possible to independently adjust the temperature of the drying air conducted to each drying zone 9*a*-9*e*, irrespective of the other zones.

In the application example according to FIG. 1, the basis weight of the web going to the drying box 1 and measured by the sensor 20, and the moisture of the web measured by the sensor 21 are used to affect the adjustment of the drying air streams conducted to the first two drying zones 9*a*, 9*b*. The moisture of the web 2 coming out of the drying box 1 and measured by the sensor 22, in turn, is used to affect the adjustment of the drying air streams conducted to the last two drying zones 9*d*, 9*e*. Furthermore, the temperature measured for the first drying zone 9*a* is used to affect the adjustment of the drying in the first two drying zones 9*a*, 9*b*, the temperature measured for the second drying zone 9*b* is used to affect the drying in the first four drying zones 9*a*-9*d*, the temperature measured for the third drying zone 9*c* is used to affect the drying in the second, third and fourth drying zones 9*b*-9*d*, the temperature measured for the fourth drying zone 9*d* is used to affect the drying in the four drying zones 9*b*-9*e*, and the temperature measured for the fifth drying zone 9*e* is used to affect the drying in the last two drying zones 9*d*, 9*e*. These connections, as well as the number of drying zones 9 in the drying box 1, however, can be varied on a case-specific basis in accordance with the quality of the pulp coming to drying and the drying objective of the process.

At its simplest, drying the web in the equipment described above, according to the invention, would be performed so that steam obtained from the channel 7*a* is used to heat the drying air in the battery 10*a* to a lower temperature, for example, less than 160° C., for the first drying zone 9*a* of the drying box 1, and the steam obtained from the channels 7*b*-7*e* and adjusted to a higher pressure and temperature is used to heat the air in the batteries 10*b*-10*e* to a higher temperature, for example, over 200° C., for the next four drying zones 9*b*-9*e* of the box. So, the drying temperature in the said four zones 9*b*-9*e* would be the same. Cooling air with a temperature lower than that of the drying air conducted to the first drying zone 9*a* could be conducted to the last cooling zone 11 from a third source. However, it is preferable to adjust the drying temperature of all the drying zones 9*a*-9*e*, with the aid of the steam valves 8, individually according to the drying need, whereby each one of these zones can operate at a different temperature.

Consequently, with the aid of the moisture and basis weight measurements fed forward in the first drying zone 9*a*, we can compensate the moisture variations in the incoming pulp web 2. The set value of the controller 25 of the drying zone 9*a* is corrected by positive feedback on the basis of the measurement results given by the basis weight and moisture sensors 20, 21 located before the drying box 1. If the moisture and the basis weight of the pulp web vary so much that the desired compensation is not reached in the drying zone 9*a*, the set value of the controller in the second drying zone 9*b* is corrected so that the desired moisture value is achieved. An evaporation level as high as possible is maintained in the drying zones 9*b*, 9*c*, and 9*d*. The pressures and the temperatures of these drying zones are adjusted individually for each drying zone by adjusting the position of the steam valve 8 so that the desired set value of the pressure or the temperature is reached. In the last drying zone 9*e*, any moisture variations in the final moisture of the pulp web are corrected. If the moisture sensor 22 that is located after the drying box 1 indicates that the desired moisture value has not been reached, the set value of the controller of the last drying zone 9*e* is corrected first. If the desired moisture value is still not achieved, the set value of the controller of the drying zone 9*d* before the last drying zone is corrected, until the desired moisture value is reached.

It is obvious to those skilled in the art that the embodiments of the invention are not limited to the above description but can vary within the following claims. In addition to the temperature of the drying air, the amount of air fed into the various drying zones can be adjusted by using valves or separate fans, for example. In this case, it is necessary to separate the zones from each other by partition walls.

The invention claimed is:

1. A method of drying a web of cellulose pulp obtained from pulping or bleaching through removal of water from the web, the method comprising the steps of:

passing the web through a series of at least two drying zones in a drying box to dry the web at different temperatures in the respective zones, blowing a first independent supply of drying air of a first temperature into a first drying zone in the drying box, to dry the web in said first temperature, blowing a second independent supply of drying air of a second temperature into a second drying zone in the drying box, to dry the web in said second temperature, said second temperature being higher than said first temperature, passing the web through a cooling zone in the drying box, subsequent to the drying zones in the path of travel of the web, and blowing an independent supply of cooling air into the cooling zone at a temperature lower than the temperature of the drying air blown into the immediately preceding drying zone, the web being routed from an inlet port to an outlet port of the drying box through a number of superimposed reciprocating runs.

2. The method according to claim 1, wherein the temperature is measured by sensors located in the various drying zones of the drying box, and that on the basis of the measurement results, the temperature of the drying air fed into the various drying zones is adjusted.

3. The method according to claim 1, wherein the moisture and the basis weight of the web going into the drying box is measured, and that on the basis of the measurement results, the temperature of the drying air fed into one or more drying zones is adjusted.

4. The method according to claim 1, wherein the moisture of the web coming out of the drying box is measured, and that on the basis of the measurement results, the temperature of the drying air fed into one or more drying zones is adjusted.

5. The method according to claim 1, wherein the temperature of the first drying zone in the web's direction of travel is adjusted to a lower level than that of one or more subsequent zones.

6. The method according to claim 1, wherein the drying air is blown from nozzles located above and below the pulp web.

7. The method according to claim 6, wherein the drying air blown from the nozzles located below the web carry the web as it travels through the drying box.

8. The method according to claim 1, wherein air with a temperature in the range of 150°-200° C. is blown into the one or more subsequent zones.

9. The method according to claim 1, wherein the drying zones comprise the horizontally superimposed web runs.

10. The method according to claim 1, wherein the drying box comprises a partition wall separating the cooling zone from the preceding drying zones.

11. The method according to claim 10, wherein the cooling zone is the lowermost zone in the drying box.

12. The method according to claim 1, wherein indoor air from the outside of the drying box is used as cooling air in the cooling zone.

13. The method according to claim 1, wherein the moisture of the web is measured before the drying box, and the measurement is used for selective adjustment of the temperature of the drying air conducted to the first drying zone.

14. The method according to claim 1, wherein the moisture of the web coming out of the drying box is measured, and the measurement is used for selective adjustment of the temperature of the drying air conducted to the last drying zone.

* * * * *